US007190246B2

(12) United States Patent
Angle et al.

(10) Patent No.: US 7,190,246 B2
(45) Date of Patent: Mar. 13, 2007

(54) GROUND FAULT CIRCUIT INTERRUPTER

(75) Inventors: Jeffrey R. Angle, Newbury, OH (US); Ronald W. Hughes, Thompson, OH (US)

(73) Assignee: Ericson Manufacturing Company, Willoughby, OH (US)

( * ) Notice: Subject to any disclaimer, the term of this patent is extended or adjusted under 35 U.S.C. 154(b) by 129 days.

(21) Appl. No.: 10/927,444

(22) Filed: Aug. 26, 2004

(65) Prior Publication Data

US 2006/0044090 A1 Mar. 2, 2006

(51) Int. Cl.
*H01H 67/02* (2006.01)
*H01H 51/22* (2006.01)

(52) U.S. Cl. ..... 335/128; 335/18; 335/80

(58) Field of Classification Search ..... 335/124–128, 335/18, 70–80
See application file for complete search history.

(56) References Cited

U.S. PATENT DOCUMENTS

| | | | | |
|---|---|---|---|---|
| 2,539,547 | A * | 1/1951 | Mossman et al. | 335/153 |
| 3,878,489 | A | 4/1975 | Rothweiler | |
| 4,149,131 | A * | 4/1979 | Kawamura et al. | 335/202 |
| 4,151,496 | A | 4/1979 | Imai et al. | |
| 4,254,392 | A * | 3/1981 | Prohaska et al. | 335/202 |
| 4,350,856 | A | 9/1982 | Shiratori et al. | |
| 4,400,761 | A | 8/1983 | Hayden et al. | |
| 4,495,480 | A | 1/1985 | Martin et al. | |
| 4,507,709 | A | 3/1985 | Morris et al. | |
| 4,533,889 | A | 8/1985 | Knight | |
| 4,893,101 | A | 1/1990 | Robitaille | |
| 4,978,935 | A * | 12/1990 | Hoffman et al. | 335/121 |
| 5,173,673 | A | 12/1992 | Weigand et al. | |
| 5,563,756 | A | 10/1996 | Ignasiak | |
| 5,568,344 | A | 10/1996 | Gernhardt et al. | |
| 5,661,623 | A | 8/1997 | McDonald et al. | |
| 5,680,287 | A | 10/1997 | Gernhardt et al. | |
| 5,864,455 | A | 1/1999 | Gernhardt et al. | |
| 5,933,063 | A | 8/1999 | Keung et al. | |
| 5,943,199 | A | 8/1999 | Aromin | |
| 6,081,176 | A * | 6/2000 | Dittmann et al. | 335/128 |
| 6,515,564 | B2 | 2/2003 | Leopold et al. | |
| 6,580,344 | B2 | 6/2003 | Li | |
| 6,738,250 | B2 | 5/2004 | Joseph et al. | |
| 6,788,176 | B2 * | 9/2004 | Schmelz | 335/80 |
| 2003/0102944 | A1 | 6/2003 | Leopold et al. | |

OTHER PUBLICATIONS

Fairchield Semiconductor, RV4145A Low Power Ground Fault Interrupter, Rev. 1.0.3 Mar. 6, 2002, pp. 1-11.

* cited by examiner

*Primary Examiner*—Elvin Enad
*Assistant Examiner*—Bernard Rojas
(74) *Attorney, Agent, or Firm*—Jones Day

(57) ABSTRACT

A ground fault circuit interrupter includes a circuit board, a magnetic relay, and an armature. The circuit board has an opening and the magnetic relay is mounted on a first side of the circuit board and aligned with the opening. The armature assembly is pivotally mounted on the second side of the circuit board and has an armature contact and moves pivotally into and out of an engaged position in which the armature contact engages a stationary contact on the second side of the circuit board.

23 Claims, 3 Drawing Sheets

GROUND FAULT CIRCUIT INTERRUPTER

This invention relates in general to safety and protection circuits, and in particular to relay configurations in such protection circuits and electrical devices utilizing the same.

A ground fault circuit interrupter (GFCI) device typically includes a monitoring circuit and a switching device, such as a solenoid or a relay. A GFCI device may be implemented in power outlets, extension cords, and other power distribution devices. Accordingly, the dimensions of the GFCI device are often considered as a design factor. The configuration of the GFCI monitoring circuitry and the switching device contributes to the overall size of the GFCI device. A novel relay configuration in response to such design factors is thus disclosed.

DRAWINGS

DETAILED DESCRIPTION

Figure 1:
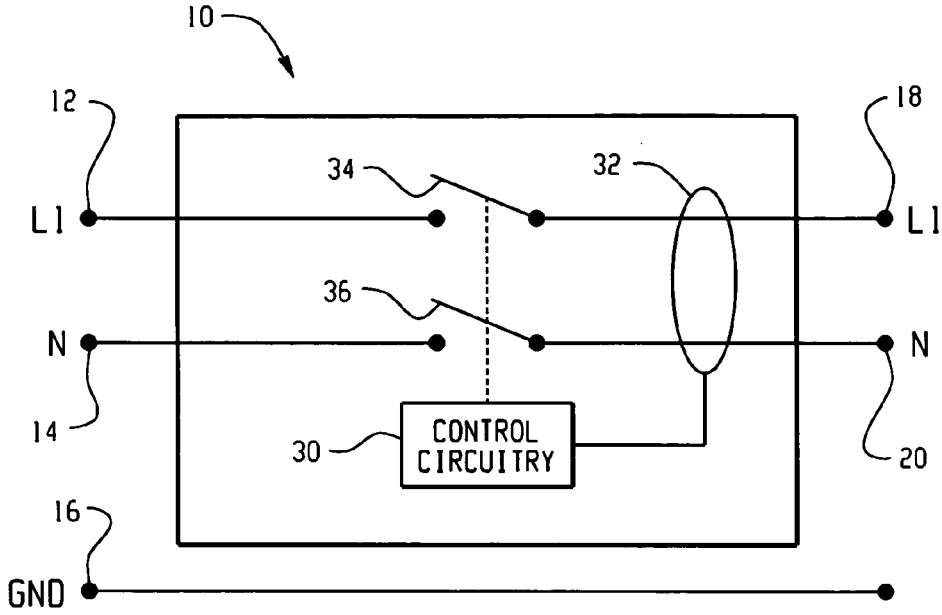
FIG. 1 is a block diagram of a GFCI device.
Figure 8:
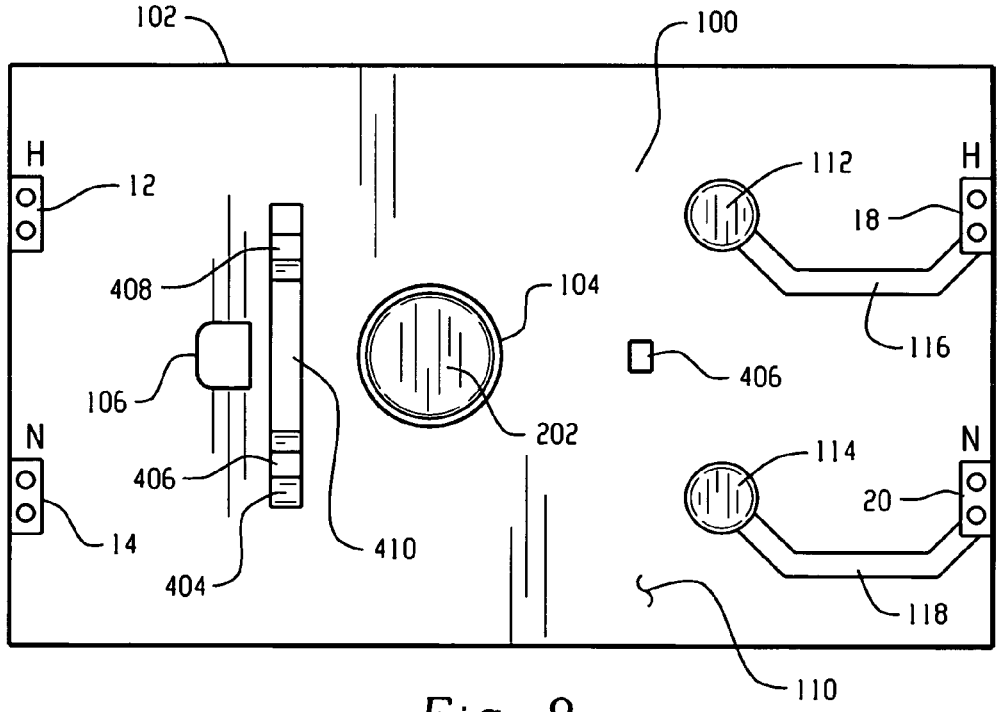
FIG. 8 is a bottom view of a circuit board of the GFCI device.

FIG. 1 is a block diagram of a GFCI device 10. The GFCI device 10 comprises a line side phase terminal 12 and a line side neutral terminal 14 referenced to a ground 16. A power source, such as 120V AC power, is provided to the line side phase and neutral terminals 12 and 14. A load side phase terminal 18 and a load side neutral terminal 20 are also referenced to ground 16 and receive an AC load.

The GFCI device 10 is operable to de-energize a circuit in response to the detection of a ground fault condition at an AC load. Control circuitry 30 is operable to monitor a current imbalance in the load side phase and neutral terminals 18 and 20. The control circuitry 30 may comprise a microprocessor, or alternatively may comprise an analog or digital logic circuit. An exemplary control circuit 30 is the Fairchild Semiconductor RV4145 Ground Fault Interrupter Controller and associated application circuitry.

The control circuitry 30 typically utilizes a sensing device 32, such as a differential current transformer, to measure the current imbalance between the load side phase and neutral terminals 18 and 20. When the current imbalance exceeds a threshold, the control circuitry 30 opens the contact 34 and 36 to enter a de-energized state that isolates a load connected to the load side phase and neutral terminals 18 and 20 from the power source on the line side phase and neutral terminals 12 and 14. The current imbalance threshold typically depends on the rating, or class, of the GFCI device 10. A Class A GFCI device, for example, trips when the ground fault current exceeds 6 mA, and a Class B GFCI device trips when the ground fault current exceeds 20 mA.

FIGS. 2–8 depict a novel GFCI device 10. A circuit board 100 defines an outer periphery 102, openings 104 and 106, and first and second opposite sides 108 and 110. The circuit board 100 may comprise a printed circuit board having one or more interconnection layers. The control circuitry 30 may be fabricated on the circuit board 100.

A pair of first and second stationary contacts 112 and 114 may be mounted on the second side 110 of the circuit board 100. The stationary contacts 112 and 114 are connected to the load side phase and neutral terminals 18 and 20, respectively, via electrical connections 116 and 118. In the example shown in FIG. 8, the electrical connections comprise solder paths that may be disposed on one or both sides of the printed circuit board 100. Other electrical connections may also be used, however. For example, the stationary contacts 112 and 114 may penetrate the top side 108 of the circuit board 100 and be connected to the load side phase and neutral terminals 18 and 20 by wiring.

A magnetic relay device 200 is mounted on the first side 108 of the circuit board 100. A relay surface 202 is aligned with the opening 104 in the circuit board 100. In the example shown, the relay surface 202 is cylindrical about an axis 208 and extends through the opening 104 so that it is located below the second side 110 of the circuit board 100. The magnetic relay device 200 may comprise a coil wrapped around a metal core encased in a bobbin 204. Selective energization of the magnetic relay device 200 by the control circuitry 30 causes the magnetic relay device 202 to generate a magnetic field that draws an armature assembly 300 toward the relay surface 202.

A frame 400 may be used to secure the magnetic relay device 200 on the first side 108 of the circuit board 100. The frame 400 may comprise an extension 404 that penetrates through the circuit board 100 and upon which the armature assembly 300 is pivotally mounted.

The armature assembly 300 comprises a metal member 302 that defines first and second recesses 304 and 306 and an armature surface region 308. The first and second recesses 304 and 306 receive first and second projections 406 and 408 of the extension 404 so that the metal member 302 is pivotally mounted on a pivot surface 410 of the extension 404.

An insulating bridge 332 is mounted on the lower side of the metal member 302. Mounted on the bridge 332 are a pair of first and second reeds 334 and 336. In the example shown, the first reed 334 included reed sections 316, 318, 320 and 322, and the second reed comprises reed sections 324, 326, 328, and 330. Each reed 334 and 336 comprises a conductive material, such as copper alloy, and the reed sections are defined by bends between each reed section.

Figure 2:
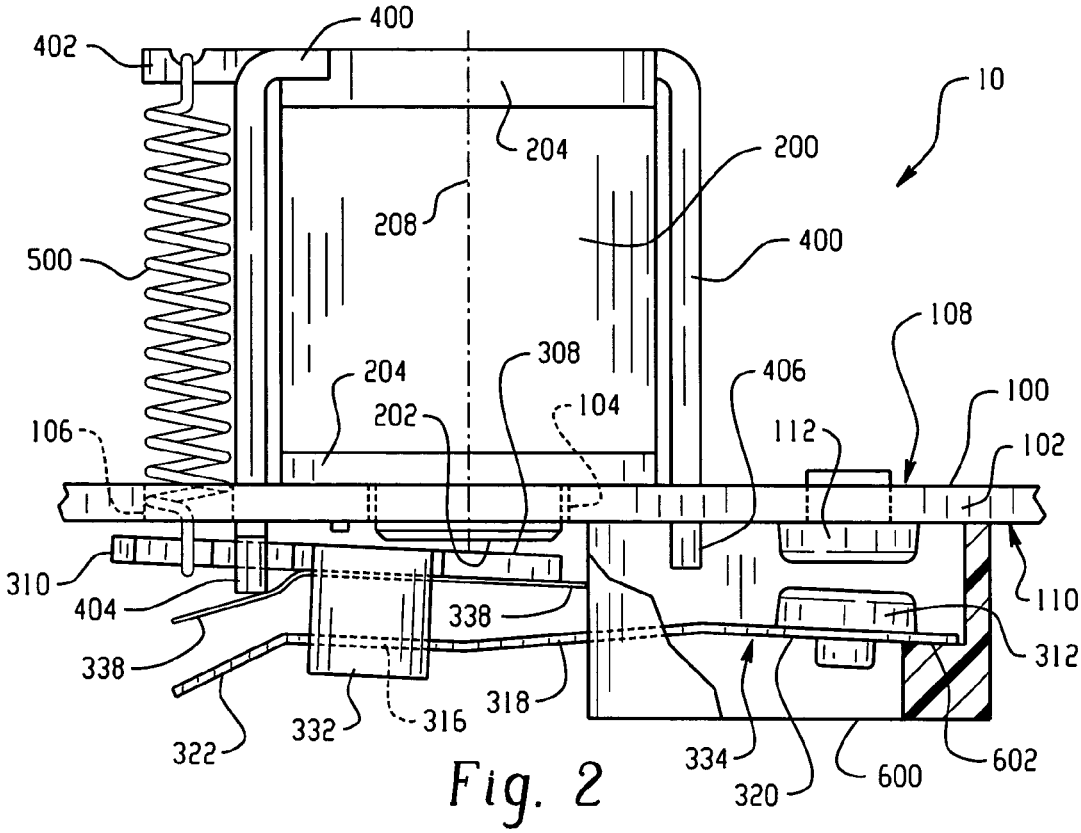
FIG. 2 is a side view of a GFCI device in a disengaged state.
Figure 3:
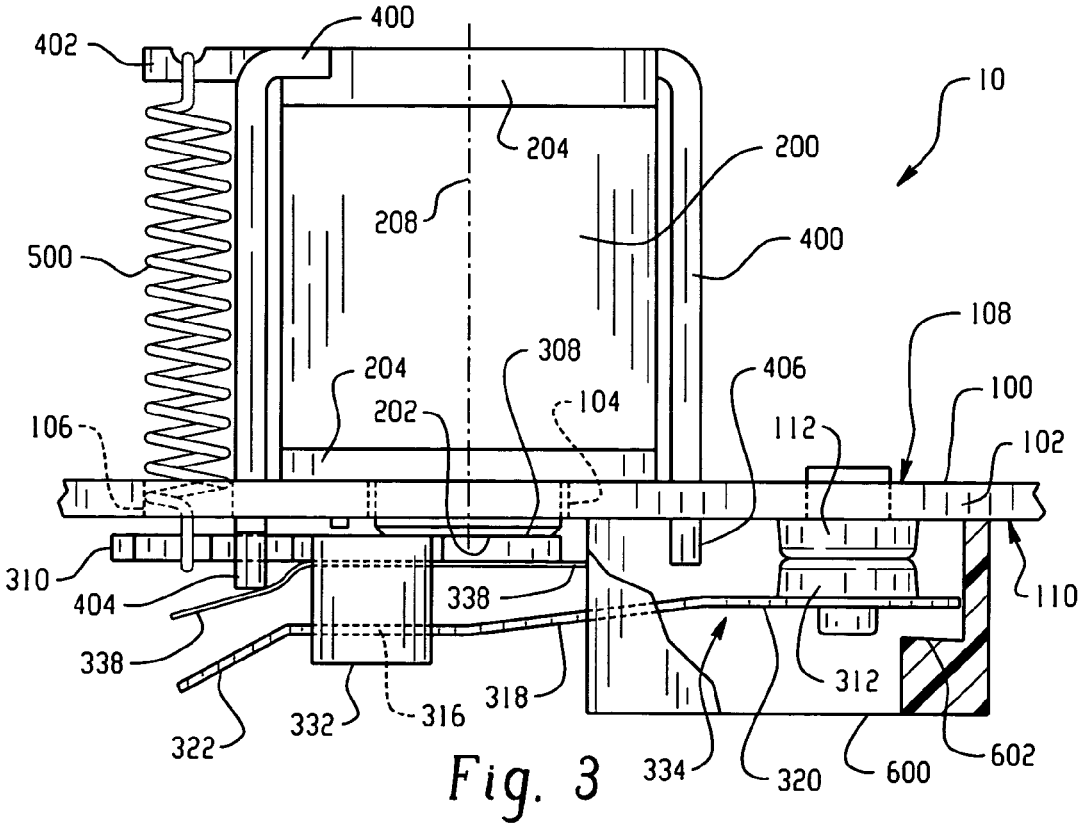
FIG. 3 is a side view of the GFCI device in an engaged state.
Figure 4:
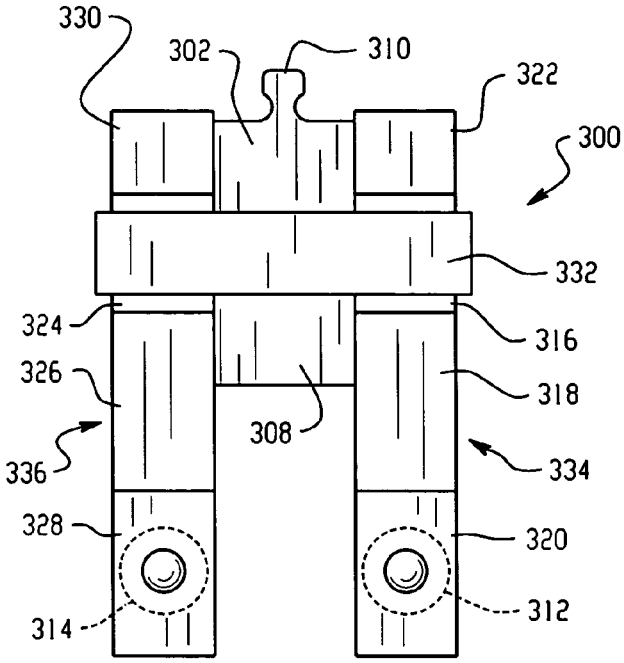
FIGS. 4–6 are top, side and bottom views of an armature of the GFCI device.
Figure 5:
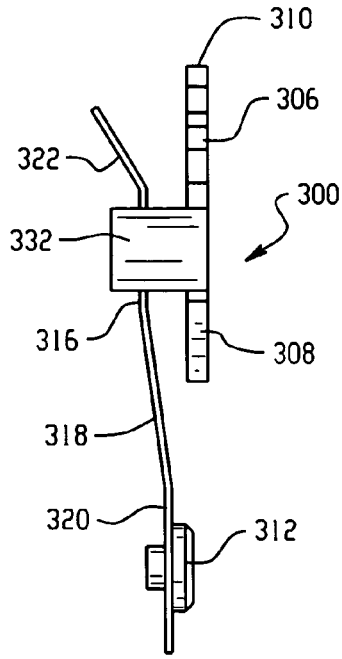
Figure 6:
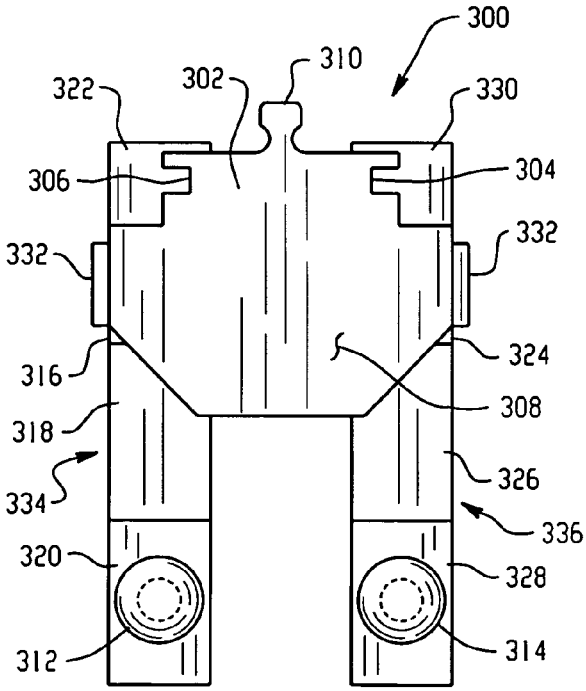
Figure 7:
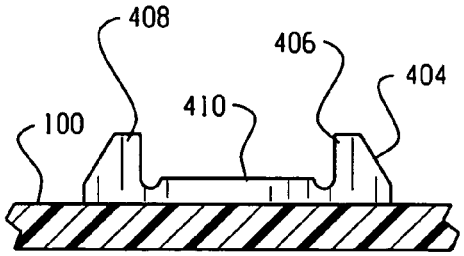
FIG. 7 is a side view of a pivotal mount for the armature.

The reed sections 320 and 328 have mounted thereon armature contacts 312 and 314, respectively. When the armature assembly 300 is pivotally mounted on the extension 404, the armature contacts 312 and 314 are aligned with the stationary contacts 112 and 114. The armature contacts 312 and 314 may thus pivotally engage the stationary contacts 112 and 114 as the armature assembly 300 pivots on the extension 404. Accordingly, the armature assembly 300 may pivotally move into an engaged position when the armature contacts 312 and 314 contact the stationary contacts 112 and 114, as shown in FIG. 3, and may pivotally move out of the engaged position when the armature contacts 312 and 314 are separated from the stationary contacts 112 and 114, as shown in FIG. 2.

An insulator 338 may also interpose the bridge 332 and the metal member 302. The insulator 338 may comprise an insulative plastic member that covers the cross-sectional area of the metal member 302. The insulator 338 prevents shorting between the metal member 302 and the reeds 334 and 336.

The frame 400 may also comprise a frame extension 402 that is aligned with an armature extension 310 and the opening 106 in the circuit board 100. A biasing device, such as a spring 500, may be connected to the armature extension 310 and the frame extension 402. The spring 500 imparts an upward force on the armature extension 310 so that the armature assembly 300 is pivotally biased out of the engaged position.

An arc shield 600 may be mounted on the second side 110 of the circuit board 100 to provide arc shielding of the stationary contacts 112 and 114 and the armature contacts 312 and 314. The arc shield 600 may also comprise a shield extension 602 positioned relative to the armature contacts 312 and 314 to limit the displacement of the armature contacts 312 and 314 from the stationary contacts 112 and 114 when the armature assembly 300 is biased out of the engaged position. In the example shown, the shield extension 602 engages reed sections 320 and 328 to limit the displacement of the armature contacts 312 and 314 from the stationary contacts 112 and 114.

The reed sections 322 and 330 are electrically connected to the line side phase and neutral terminals 12 and 14, respectively. In one embodiment, the reed sections 322 and 330 are connected to line side phase and neutral terminals 12 and 14 by a pair of flexible copper rope wires.

In operation, the control circuitry 30 on the printed circuit board 100 monitors for a current imbalance between the phase and neutral lines. The current imbalance may be monitored relative to the line side phase and neutral terminals 12 and 14 or the load side phase and neutral terminals 18 and 20. As long as the current imbalance is below a threshold, the control circuitry 30 will energize the magnetic relay device 200.

The energization of the magnetic relay device 200 generates a magnetic field that overcomes the biasing force imparted by the spring 500 and draws the armature surface 308 of the armature assembly 300 toward the relay surface 202. The movement of the armature surface 308 towards the relay surface 202 causes the armature assembly 300 to pivotally move into the engaged position.

In one embodiment, the armature contacts 312 and 314 engage the stationary contacts 112 and 114 before the armature surface 308 contacts the relay surface 202. After the armature contacts 312 and 314 engage the stationary contacts 112 and 114, the armature surface 308 continues to move toward the relay surface 202 until the two surfaces contact. The additional pivotal movement of the armature surface 308 is accommodated by a slight flexing of the first and second reeds 334 and 336.

If the current imbalance is above the threshold, the control circuitry 30 will de-energize the magnetic relay device 200. The magnetic field is thus eliminated and the biasing force imparted by the spring 500 pivotally moves the armature assembly 300 out of the engaged position, which isolates the AC load on the load side phase and neutral terminals 18 and 20 from the line side phase and neutral terminals 12 and 14.

The GFCI device 10 disclosed herein may be implemented in a variety of electrical devices for ground fault protection. For example, the GFCI device of FIGS. 2–8 may be implemented in an extension cord having ground fault protection or an electrical outlet having ground fault protection.

This written description sets forth the best mode of the claimed invention, and describes the claimed invention to enable a person of ordinary skill in the art to make and use it, by presenting examples of the elements recited in the claims. The patentable scope of the invention is defined by the claims themselves, and may include other examples that occur to those skilled in the art. Such other examples, which may be available either before or after the application filing date, are intended to be within the scope of the claims if they have structural elements that do not differ from the literal language of the claims, or if they include equivalent structural elements with insubstantial differences from the literal language of the claims.

What is claimed is:

1. An apparatus, comprising:

a circuit board having an outer periphery, first and second opposite sides, and an opening within the outer periphery that extends through the circuit board;

a magnetic relay device mounted on the first side of the circuit board and having a relay surface aligned with the opening;

a stationary contact on the second side of the circuit board;

an armature assembly including an armature surface and an armature contact, and being mounted on the second side of the circuit board for movement pivotally into and out of an engaged position in which the armature contact engages the stationary contact and the armature surface engages the relay surface, a relay frame mounted on the first side of the circuit board and configured to secure the magnetic relay device in position on the first side of the circuit board, the relay frame including a fulcrum extension that penetrates through the circuit board and upon which the armature assembly is pivotally mounted on the second side of the circuit board, a spring for biasing the armature assembly pivotally out of the engaged position, and an arc shield mounted on the second side of the circuit board and proximate to the armature contact, the arc shield further comprising a shield extension positioned relative to the armature contact to limit the displacement of the armature contact from the stationary contact when the armature assembly is moved pivotally out of the engaged position under the bias of the spring.

2. The apparatus of claim 1, wherein the spring extends between the second side of the circuit board and the armature assembly, and the fulcrum extension is located between the spring and the opening in the circuit board.

3. The apparatus of claim 2, wherein the relay surface extends through the opening in the circuit board and is located below the second side of the circuit board.

4. The apparatus of claim 1, wherein the fulcrum extension is positioned relative to the stationary contact so that the opening in the circuit board is interposed between the fulcrum extension and the stationary contact.

5. The apparatus of claim 1, further comprising a fulcrum extension mounted on the second side of the circuit board and upon which the armature assembly is pivotally mounted.

6. The apparatus of claim 5, further comprising a spring for biasing the armature assembly pivotally out of the engaged position.

7. The apparatus of claim 1, wherein the armature contact is positioned relative to the armature surface such that the armature contact engages the stationary contact prior to the armature surface engaging the relay surface.

8. The apparatus of claim 1, further comprising:

an AC electrical cord configured to be connected to an AC power source and receive at least one AC electrical plug and couple the AC power source to the AC plug; and ground fault interrupter monitoring circuitry disposed on the circuit board and in electrical communication with the AC electrical cord and operable to sense a ground fault condition and selectively energize and de-energize the magnetic relay device in response.

9. A ground fault circuit interrupter apparatus, comprising:

a printed circuit board defining an outer periphery, first and second surfaces, and an opening within the outer periphery that extends through the circuit board;

a magnetic relay device defining a relay surface and positioned on the first surface of the circuit board and disposed over the opening defined by the printed circuit board so that the relay surface is aligned with the opening;

a stationary contact positioned on the second surface of the printed circuit board;

an armature assembly pivotally mounted on the second surface of the printed circuit board, the armature assembly defining a pivotal region and comprising an armature surface on a first side of the pivotal region and below the relay surface, and an armature contact aligned with the stationary contact;

wherein the armature contact and the stationary contact are in an open position when the magnetic relay device is in a disengaged state and the armature contact and the stationary contact are in a closed position when the magnetic relay device is in an engaged state, a relay frame positioned on the first surface of the printed circuit board and configured to secure the magnetic relay device in position on the first surface of the printed circuit board, the relay frame comprising a fulcrum extension that penetrates through the first and second surfaces of the printed circuit board and upon which the armature assembly is pivotally mounted;

wherein the relay frame further comprises a frame extension spaced above the first surface of the printed circuit board, the armature assembly further comprises an armature extension positioned on a second side of the pivotal region and aligned with the frame extension, and a bias spring connected between the frame extension and the armature extension, the bias spring operable to bias the armature contact and the stationary contact in an open position when the magnetic relay device is in a disengaged state.

10. The apparatus of claim 9, further comprising an arc shield positioned on the second surface of the printed circuit board and proximate the armature contact and the stationary contact, the arc shield further comprising a shield extension below the second surface of the printed circuit board, the shield extension positioned relative to the armature contact to limit the displacement of the armature contact from the stationary contact when the magnetic relay device is in a disengaged state.

11. The apparatus of claim 10, wherein the relay surface penetrates the opening defined by the printed circuit board and extends below the second surface of the printed circuit board.

12. The apparatus of claim 9, wherein the fulcrum extension is positioned relative to the stationary contact so that the opening defined by the printed circuit board is interposed between the fulcrum extension and the stationary contact.

13. The apparatus of claim 8, wherein the armature assembly further comprises a conductive reed and wherein the armature contact is connected to a distal region of the conduct reed.

14. The apparatus of claim 13, wherein the armature contact engages the stationary contact prior to an engagement of the armature surface and the relay surface.

15. An apparatus, comprising:

a circuit board having an outer periphery, first and second opposite sides, and an opening within the outer periphery that extends through the circuit board;

a magnetic relay device mounted on the first side of the circuit board and having a relay surface aligned with the opening;

a stationary contact on the second side of the circuit board;

an armature assembly including an armature surface and an armature contact, and being mounted on the second side of the circuit board for movement pivotally into and out of an engaged position in which the armature contact engages the stationary contact and the armature surface engages the relay surface, and a relay frame mounted on the first side of the circuit board and configured to secure the magnetic relay device in position on the first side of the circuit board, the relay frame including a fulcrum extension that penetrates through the circuit board and upon which the armature assembly is pivotally mounted on the second side of the circuit board, a spring for biasing the armature assembly pivotally out of the engaged position, wherein the spring extends between the second side of the circuit board and the armature assembly, and the fulcrum extension is located between the spring and the opening in the circuit board;

wherein the relay surface extends through the opening in the circuit board and is located below the second side of the circuit board.

16. The apparatus of claim 15, wherein the fulcrum extension is positioned relative to the stationary contact so that the opening in the circuit board is interposed between the fulcrum and the stationary contact.

17. The apparatus of claim 15, further comprising a fulcrum extension mounted on the second side of the circuit board and upon which the armature assembly is pivotally mounted.

18. An apparatus, comprising:

a circuit board having an outer periphery, first and second opposite sides, and an opening within the outer periphery that extends through the circuit board;

a magnetic relay device mounted on the first side of the circuit board and having a relay surface aligned with the opening;

a stationary contact on the second side of the circuit board;

an armature assembly including an armature surface and an armature contact, and being mounted on the second side of the circuit board for movement pivotally into and out of an engaged position in which the armature contact engages the stationary contact and the armature surface engages the relay surface;

a fulcrum extension mounted on the second side of the circuit board and upon which the armature assembly is pivotally mounted; and a spring for biasing the armature assembly pivotally out of the engaged position.

19. The apparatus of claim 18, wherein the armature contact is positioned relative to the armature surface such that the armature contact engages the stationary contact prior to the armature surface engaging the relay surface.

20. The apparatus of claim 18, further comprising:

an AC electrical cord configured to be connected to an AC power source and receive at least one AC electrical plug and couple the AC power source to the AC plug; and ground fault interrupter monitoring circuitry disposed on the circuit board and in electrical communication with the AC electrical cord and operable to sense a ground fault condition and selectively energize and de-energize the magnetic relay device in response.

21. A ground fault circuit interrupter apparatus, comprising:

a printed circuit board defining an outer periphery, first and second surfaces, and an opening within the outer periphery that extends through the circuit board;

a magnetic relay device defining a relay surface and positioned on the first surface of the circuit board and disposed over the opening defined by the printed circuit board so that the relay surface is aligned with the opening;

a stationary contact positioned on the second surface of the printed circuit board;

an armature assembly pivotally mounted on the second surface of the printed circuit board, the armature assembly defining a pivotal region and comprising an armature surface on a first side of the pivotal region and below the relay surface, and an armature contact aligned with the stationary contact;

wherein the armature contact and the stationary contact are in an open position when the magnetic relay device is in a disengaged state and the armature contact and the stationary contact are in a closed position when the magnetic relay device is in an engaged state, and a relay frame positioned on the first surface of the printed circuit board and configured to secure the magnetic relay device in position on the first surface of the printed circuit board, the relay frame comprising a fulcrum extension that penetrates through the first and second surfaces of the printed circuit board and upon which the armature assembly is pivotally mounted;

wherein the fulcrum extension is positioned relative to the stationary contact so that the opening defined by the printed circuit board is interposed between the fulcrum extension and the stationary contact.

22. The apparatus of claim 21, further comprising an arc shield positioned on the second surface of the printed circuit board and proximate to the armature contact and the stationary contact, the arc shield further comprising a shield extension positioned relative to the armature contact to limit the displacement of the armature contact from the stationary contact when the magnetic relay device is in a disengaged state.

23. The apparatus of claim 22, wherein the relay surface penetrates the opening defined by the printed circuit board and extends below the second surface of the printed circuit board.

* * * * *